US010255878B2

(12) United States Patent
Hung et al.

(10) Patent No.: US 10,255,878 B2
(45) Date of Patent: Apr. 9, 2019

(54) PIXEL ARRAY

(71) Applicant: AU Optronics Corporation, Hsin-Chu (TW)

(72) Inventors: I-Hsuan Hung, Hsin-Chu (TW); Yu-Hsin Ting, Hsin-Chu (TW); I-Fang Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 67 days.

(21) Appl. No.: 15/494,637

(22) Filed: Apr. 24, 2017

(65) Prior Publication Data

US 2017/0309247 A1 Oct. 26, 2017

(30) Foreign Application Priority Data

Apr. 25, 2016 (TW) ..... 105112843 A

(51) Int. Cl.
*G09G 5/02* (2006.01)
*G09G 3/20* (2006.01)

(52) U.S. Cl.
CPC ..... *G09G 5/02* (2013.01); *G09G 3/2003* (2013.01); *G09G 3/2074* (2013.01); *G09G 2300/0426* (2013.01); *G09G 2300/0452* (2013.01); *G09G 2300/08* (2013.01); *G09G 2310/0262* (2013.01); *G09G 2380/02* (2013.01)

(58) Field of Classification Search
CPC ..... G09G 5/02; G09G 3/2074; G09G 3/2003; G09G 2380/02; G09G 2300/08; G09G 2300/0452; G09G 2300/0426; G09G 2310/0262
See application file for complete search history.

(56) References Cited

U.S. PATENT DOCUMENTS

2008/0117150 A1 5/2008 Tak et al.
2008/0158097 A1* 7/2008 Guo ..... G09G 5/02 345/55
2015/0348470 A1* 12/2015 Wang ..... G02B 5/201 345/694
2016/0087014 A1 3/2016 Ahn et al.

FOREIGN PATENT DOCUMENTS

CN 2705844 Y 6/2005
CN 101153930 A 4/2008
CN 101393366 A 3/2009
CN 104050889 A 9/2014
CN 104465707 A 3/2015
JP 2006201485 A 8/2006

OTHER PUBLICATIONS

State Intellectual Property Office of the People's Republic of China , "Office Action", dated Mar. 23, 2018.

* cited by examiner

*Primary Examiner* — Aneeta Yodichkas
(74) *Attorney, Agent, or Firm* — WPAT, PC

(57) ABSTRACT

A pixel array includes pixel sets adjacent to each other. A pixel set includes two pixels. Each pixel includes three sub-pixels having a quadrilateral shape. Two adjacent edges of any one of the sub-pixels adjoin the other two sub-pixels, respectively, so that each pixel has a hexagonal shape. Sub-pixels of the pixel have different colors. After a rotation by 180 degrees, shapes of three sub-pixels of one pixel in a pixel set are substantially the same as shapes of three sub-pixels of the other pixel in the pixel set, and adjacent two sub-pixels of two pixels correspond to each other.

19 Claims, 8 Drawing Sheets

PIXEL ARRAY

BACKGROUND

Technical Field

The present invention relates to a pixel array, and more particularly to a non-rectangular pixel array.

Related Art

As display apparatuses become increasingly lightweight and thin, display apparatuses are gradually applied in an increasingly large variety of electronic products, to display related information that is to be presented to a user by the electronic products. However, to adapt to applications whose diversity grows on a daily basis, for example, for display apparatuses that are applied to electronic products such as wearable apparatuses, touch apparatuses or home appliances, emission mode, grayscale display, and power consumption of the display apparatuses all undergo substantial changes. By comparison, pixel array included in most display apparatuses have relatively small changes. Under the limitations of various outer frames having different shapes of different electronic products, in most display apparatuses, a square or rectangular pixel is still used as a basic unit of a pixel array, and square or rectangular pixels are combined and used for coverage to fill a display shape of a display surface defined by an outer frame, so that a larger pixel area can be covered, and a relatively simple control circuit can be used to control a display status of a pixel.

Certainly, a pixel array in which a square or a rectangle is used as a basic unit can efficiently cover central parts of outer frames having different shapes. However, even if the resolution of square or rectangular basic units is increased, edge areas of outer frames of most display apparatuses still cannot be efficiently covered. Furthermore, in a case in which the increase of the resolution of a basic unit for a pixel has an upper limit, the performance of the basic unit is limited further. Therefore, in an edge area of an outer frame of a non-rectangular display apparatus, the color of a sub-pixel may be not able to be completely displayed because the sub-pixel is blocked by the outer frame, and as a result, the color of a pixel in the edge area cannot be normally displayed because of abnormal mixing of colors. In addition, if pixels in edge areas are discarded and boundaries of pixel sets are shrunk or if pixels that have abnormal mixing of colors are enable to display a color, sawtooth shapes may appear at edges of display areas of outer frames and result in an uneven appearance. As can be seen, in the foregoing existing architecture, apparently inconvenience and defects still exist, and further development needs to be made, so that display areas of display modules having different shapes can be efficiently filled by a pixel array. To solve the foregoing problem, a solution is sought for eagerly in the related art. However, no suitable manner has been developed and completed for a long time. Therefore, how to effectively solve the foregoing problem is one of the important development subjects at present, and also becomes an objective for which improvements need to be made in the related art at present.

SUMMARY

A technical aspect of the present invention relates to pixel sets in a pixel array. A pixel set is formed of two hexagonal pixels, and the pixel sets are combined by using such a pixel set as a basic unit of the pixel array, so as to cover to the greatest extent display shapes of display surfaces defined by outer frames of various different display apparatuses, so that the pixel sets can more efficiently fill space inside the outer frames having different shapes, especially an area near an edge of an outer frame. In addition, by configuring a manner of dividing a pixel into sub-pixels, for the pixel set of the present invention, a relatively simple control circuit can still be used to control a display status of a pixel. In this way, the pixel array can cover display surfaces defined by outer frames of display apparatuses having different shapes more desirably and more efficiently without increasing the complexity of a control circuit, so as to reduce or avoid relatively undesirable effects of color emission and relatively undesirable image effects that occur in edge areas of the outer frames of the display apparatuses.

The present invention provides a pixel array, including a plurality of pixel sets. The plurality of pixel sets is adjacent to each other. Each pixel set separately includes a first pixel and a second pixel. The first pixel includes a first sub-pixel, a second sub-pixel, and a third sub-pixel. The first sub-pixel, the second sub-pixel, and the third sub-pixel have a quadrilateral shape. Two adjacent edges of any one of the first sub-pixel, the second sub-pixel, and the third sub-pixel adjoin the other two of the first sub-pixel, the second sub-pixel, and the third sub-pixel, respectively, so that the first pixel has a hexagonal shape. The first sub-pixel, the second sub-pixel, and the third sub-pixel have different colors. The second pixel includes a fourth sub-pixel, a fifth sub-pixel, and a sixth sub-pixel. The fourth sub-pixel, the fifth sub-pixel, and the sixth sub-pixel have a quadrilateral shape. Two adjacent edges of any one of the fourth sub-pixel, the fifth sub-pixel, and the sixth sub-pixel adjoin the other two of the fourth sub-pixel, the fifth sub-pixel, and the sixth sub-pixel, respectively, so that the second pixel has a hexagonal shape. The fourth sub-pixel, the fifth sub-pixel, and the sixth sub-pixel have different colors. After a rotation by 180 degrees, shapes of the first sub-pixel, the second sub-pixel, and the third sub-pixel of the first pixel are substantially the same as shapes of the fourth sub-pixel, the fifth sub-pixel, and the sixth sub-pixel of the second pixel, and the fourth sub-pixel corresponds to the first sub-pixel. The fourth sub-pixel of the second pixel adjoins the first sub-pixel of the first pixel.

In one or more embodiments of the present invention, the first sub-pixel and the fourth sub-pixel have different colors.

In one or more embodiments of the present invention, the colors of the first sub-pixel, the second sub-pixel, the third sub-pixel, the fourth sub-pixel, the fifth sub-pixel, and the sixth sub-pixel are red, blue or green, respectively.

In one or more embodiments of the present invention, the colors of the first sub-pixel, the second sub-pixel, the third sub-pixel, the fourth sub-pixel, the fifth sub-pixel, and the sixth sub-pixel are yellow, cyan or magenta, respectively.

In one or more embodiments of the present invention, the first sub-pixel, the second sub-pixel, the third sub-pixel, the fourth sub-pixel, the fifth sub-pixel, and the sixth sub-pixel have a parallelogram shape.

In one or more embodiments of the present invention, the first sub-pixel and the fourth sub-pixel have a rhombic shape. The second sub-pixel, the third sub-pixel, the fifth sub-pixel, and the sixth sub-pixel have a parallelogram shape.

In one or more embodiments of the present invention, the second sub-pixel and the third sub-pixel are rhombuses having a edge lengths equal to those of the first sub-pixel, so that the first pixel has a regular hexagonal shape. The fifth sub-pixel and the sixth sub-pixel are rhombuses having a edge lengths equal to those of the fourth sub-pixel, so that the second pixel has a regular hexagonal shape.

In one or more embodiments of the present invention, an edge where the second sub-pixel and the third sub-pixel adjoin each other is parallel to a first direction, and an edge where the fifth sub-pixel and the sixth sub-pixel adjoin each other is parallel to the first direction.

In one or more embodiments of the present invention, the first sub-pixels and the fourth sub-pixels substantially adjoin each other in sequence in a second direction perpendicular to the first direction. The second sub-pixels and the third sub-pixels substantially adjoin each other alternately along the second direction. The fifth sub-pixels and the sixth sub-pixels substantially adjoin each other alternately along the second direction.

In one or more embodiments of the present invention, the second sub-pixel of any pixel set adjoins the sixth sub-pixel of a second pixel set in the first direction, and the third sub-pixel of the any pixel set adjoins the fifth sub-pixel of a third pixel set in the first direction.

In one or more embodiments of the present invention, an arrangement manner of the plurality of pixel sets is a honeycomb-like arrangement.

In one or more embodiments of the present invention, a first edge of the first sub-pixel and a first edge of the second sub-pixel adjoin each other, a second edge of the first sub-pixel and a first edge of the third sub-pixel adjoin each other, and a second edge of the second sub-pixel and a second edge of the third sub-pixel adjoin each other. The first edge and the second edge of the first sub-pixel are connected, the first edge and the second edge of the second sub-pixel are connected, the first edge and the second edge of the third sub-pixel are connected, and a third edge and a fourth edge of the first sub-pixel, a third edge and a fourth edge of the second sub-pixel, and a third edge and a fourth edge of the third sub-pixel are sequentially connected and are served as six edges of a hexagon and combined to form the first pixel. A first edge of the fourth sub-pixel and a first edge of the fifth sub-pixel adjoin each other, a second edge of the fourth sub-pixel and a first edge of the sixth sub-pixel adjoin each other, and a second edge of the fifth sub-pixel and a second edge of the sixth sub-pixel adjoin each other. The first edge and the second edge of the fourth sub-pixel are connected, the first edge and the second edge of the fifth sub-pixel are connected, the first edge and the second edge of the sixth sub-pixel are connected, and a third edge and a fourth edge of the fourth sub-pixel, a third edge and a fourth edge of the fifth sub-pixel, and a third edge and a fourth edge of the sixth sub-pixel are sequentially connected and are served as six edges of a hexagon and combined to form the second pixel.

In one or more embodiments of the present invention, the pixel array further includes a plurality of data line sets and a plurality of scan lines. Each data line set includes a first data line, a second data line, and a third data line. The first data line extends along the first edges and the second edge of the fourth sub-pixels of a plurality of adjacent pixel sets. The second data line extends along the first edge and the second edge of the first sub-pixels of the plurality of adjacent pixel sets. The third data line extends along the fourth edges of the second sub-pixels and the third edges of the third sub-pixels of the plurality of adjacent pixel sets. The plurality of scan lines is disposed parallel to each other. The scan lines are electrically connected to the first data lines, the second data lines, and the third data lines, respectively by using the first data line, the second data line, and the third data line.

In one or more embodiments of the present invention, each of the first data lines, the second data lines, and the third data lines has a plurality of bending points, wherein the scan lines intersect with the first data lines, the second data lines, and the third data lines at the bending points, respectively.

In one or more embodiments of the present invention, an edge where the second sub-pixel and the third sub-pixel adjoin each other is parallel to a first direction, and a plurality of scan lines substantially extends in the first direction, and traverses a plurality of first sub-pixels and a plurality of fourth sub-pixels, respectively.

In one or more embodiments of the present invention, the scan lines and one of the first data lines control the first sub-pixel or the fourth sub-pixel traversed by the scan line.

In one or more embodiments of the present invention, the second data line and the scan lines control the second sub-pixel and the third sub-pixel, and the third data line and the scan lines control the fifth sub-pixel and the sixth sub-pixel.

In one or more embodiments of the present invention, the pixel array further includes a plurality of scan lines and a plurality of data lines. A plurality of the scan lines extends along the first edges and the second edges of the fourth sub-pixels, respectively. Another plurality of the scan lines extends along the first edges and the second edges of the first sub-pixel, respectively. Another plurality of the scan lines extend along the fourth edges of the second sub-pixels and the third edges of the third sub-pixels, respectively. The data lines are disposed parallel to each other. The data lines are electrically connected to the scan lines by using the scan lines, respectively.

In one or more embodiments of the present invention, the pixel array further includes a plurality of first signal lines, a plurality of second signal lines, and a plurality of transistors. Each first signal line has a plurality of bending points. One of the first signal lines extends along an edge where the first sub-pixel and a second sub-pixel adjoin each other and an edge where the first sub-pixel and a third sub-pixel adjoin each other. One of the first signal lines extends along an edge where the fourth sub-pixel and the fifth sub-pixel adjoin each other and an edge where the fourth sub-pixel and the sixth sub-pixel adjoin each other. One of the first signal lines extends along an edge where the second sub-pixel and the sixth sub-pixel adjoin each other and an edge where the third sub-pixel and the fifth sub-pixel adjoin each other. The plurality of second signal lines is disposed parallel to each other and intersect with the plurality of first signal lines at the bending points, respectively. One of the second signal lines extends along an edge where the second sub-pixel and the third sub-pixel adjoin each other and an edge where the fifth sub-pixel and the sixth sub-pixel adjoin each other and traverses the plurality of first sub-pixels. One of the second signal lines extends along an edge where the second sub-pixel and the third sub-pixel adjoin each other and an edge where the fifth sub-pixel and the sixth sub-pixel adjoin each other and traverses the plurality of fourth sub-pixels. The plurality of transistors is used to control the sub-pixels of the corresponding pixel sets. The transistors are located at positions of intersections of the first signal lines and the second signal lines, respectively, and are electrically connected to one of the corresponding first signal lines and one of the corresponding second signal lines, respectively.

BRIEF DESCRIPTION OF THE DRAWINGS

To make the foregoing and other objectives, features, and advantages of the present invention and the embodiments more comprehensible, the accompanying drawings are described as follows.

Unless otherwise indicated, a same number or symbol in different drawings is usually regarded as a corresponding part. The drawings are used to clearly express correlations between the embodiments rather than to show actual sizes.

DETAILED DESCRIPTION

A plurality of embodiments of the present invention is disclosed below with reference to the accompanying drawings. For clear description, many details in practice will be described together in the following description. However, it should be understood that these details in practice should not be used to limit the present invention. That is, in some of the embodiments of the present invention, these details in practice are not essential. In addition, to simplify the accompanying drawings, some conventional structures and components are shown in a simple schematic manner in the accompanying drawings.

Herein, it may be understood that words such as first, second and third are used to describe various elements, components, areas, layers and/or blocks. However, these elements, components, areas, layers and/or blocks should not be limited by these terms. These words are only used for distinguishing between single elements, components, areas, layers and/or blocks. Therefore, a first element, component, area, layer and/or block hereinafter may also be referred to as a second element, component, area, layer and/or block without departing from the concept of the present invention.

Figure 1:
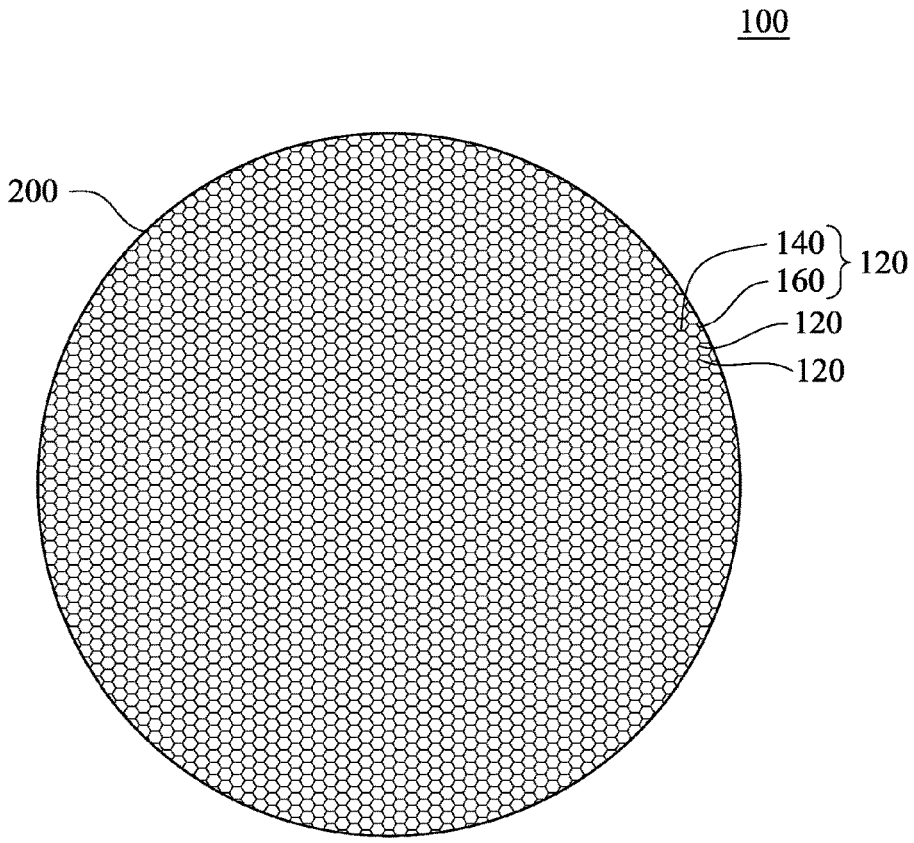
FIG. 1 is a schematic diagram of a pixel array according to multiple embodiments of the present invention.
Figure 2:
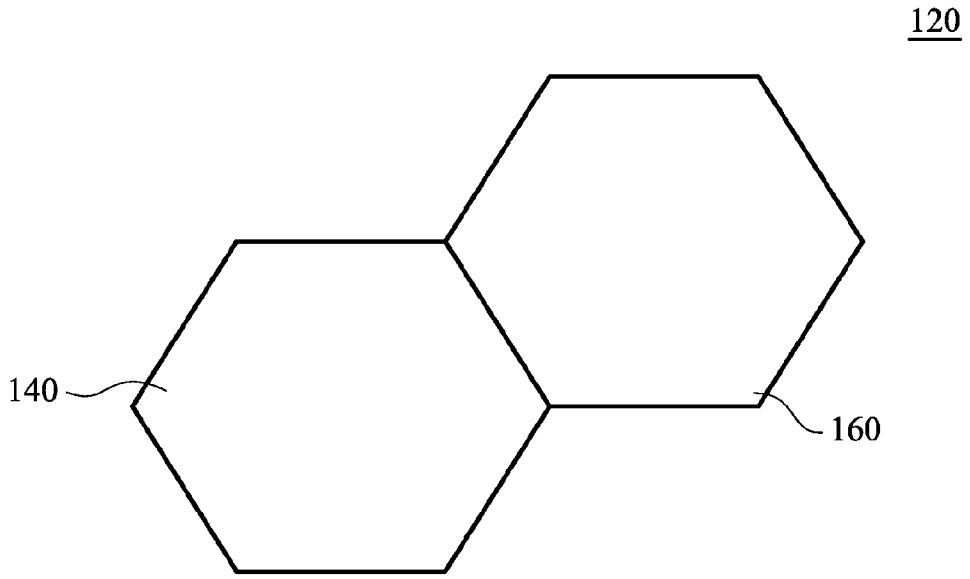
FIG. 2 is a schematic diagram of a pixel set according to multiple embodiments of the present invention.

FIG. 1 is a schematic diagram of a pixel array 100 according to multiple embodiments of the present invention. FIG. 2 is a schematic diagram of a pixel set 120 according to multiple embodiments of the present invention. Referring to FIG. 1, the pixel array 100 includes a plurality of first pixels 140 and second pixels 160. Each of the first pixels 140 and the second pixels 160 has a hexagonal shape, and the first pixels 140 and the second pixels 160 are adjacent to each other. However, to simplify a driving manner of driving the first pixels 140 and the second pixel 160, the first pixels 140 and the second pixels 160 in the pixel array 100 may be further combined two by two to form pixel sets 120 (as shown in FIG. 2), so that corresponding control circuitry can be disposed easily, and is described in detail hereinafter. It should be noted that, the shape of an outer frame 200 and a covering manner of the first pixels 140 and the second pixel 160 discussed herein are merely exemplary, and are not used to limit a shape of an outer frame or a covering manner to use that may be applicable to the present invention. In addition, the outer frame 200 discussed herein may be an outer edge or an edge of a display area. In some of the multiple embodiments, the pixel array 100 in the outer frame 200 has only complete first pixels 140 and second pixels 160, while a first pixel 140 or a second pixel 160 in the pixel array 100 that overlap the outer frame 200 are discarded, so that the pixel array 100 is shrunk in the outer frame 200. In other multiple embodiments, the pixel array 100 may have an incomplete first pixel 140 or second pixel 160 at an edge of the outer frame 200, so as to fill space in the outer frame 200. A pixel that is partially beyond a range defined by the outer frame 200 may still work normally, but only light emitted from a part that is located inside the range defined by the outer frame 200 can be displayed on a display apparatus. It should be understood that a person of ordinary skill in the art may make a moderate change or replacement according to an actual need without departing from the spirit and scope of the present disclosure, as long as space inside the outer frame 200 can be covered to the greatest extent and a visual effect of display of the outer frame 200 is relatively smooth at the edge. In multiple embodiments, an arrangement manner of the plurality of first pixels 140 and second pixels 160 is substantially similar to a honeycomb-like arrangement.

Because the pixel array 100 is formed by using a hexagonal pixel such as the first pixel 140 and the second pixel 160 as a basic unit, as compared with a rectangular or square pixel, after hexagonal pixels are combined, space in display shapes defined by the outer frames 200 having various different shapes, especially, an area relatively near an edge of the outer frame 200, may be covered more efficiently to the greatest extent. For example, in some of the embodiments, for the circular outer frame 200 shown in FIG. 1, in a condition in which the pixels are not beyond the outer frame 200, a coverage rate of the pixel array 100 formed of hexagons having same edge lengths is 99.836%. By comparison, when space in the outer frame 200 is filled by using squares having same edge lengths, the coverage rate is reduced to 98.851%. If analysis is performed on only areas near edges of the outer frame 200, such a difference between the percentages becomes even larger. As can be seen, when a hexagonal pixel is used as a basic unit, the pixel array 100 can more desirably and more efficiently cover display surfaces defined by the outer frames 200 of display apparatuses having different shapes, so as to reduce or avoid relatively undesirable effects of color emission and relatively undesirable image effects that occur in edge areas of the outer frames 200 of the display apparatuses. Especially, an application to a non-rectangular outer frame has a more desirable effect. It should be noted that, the regular hexagonal shown herein is merely exemplary, and the hexagonal shape of the present invention is not limited to only a regular hexagonal shape.

In addition, as compared with an included angle of 90 degrees that is formed between two edges, an included angle formed between two edges of a hexagon is usually an obtuse angle greater than 90 degrees, so that outer edges formed by two adjacent hexagons do not have a step form, and instead has a relatively gentle slope. Meanwhile, edges between two adjacent hexagons are not aligned as in a matrix formed of square or rectangular pixels. Therefore, hexagons located at the outermost portion of the pixel array 100 can slightly mitigate a visual effect of saw-tooth shaped edges as compared with saw-tooth shaped edges of a pixel array in which a rectangle or square is used as a basic unit.

Figure 3:
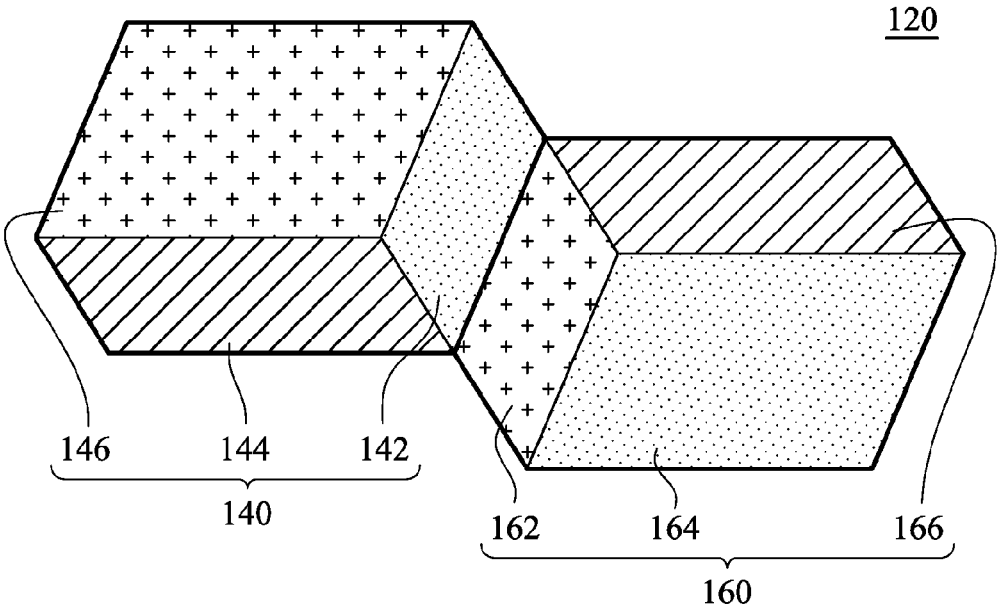
FIG. 3 is a schematic diagram of a pixel set according to multiple embodiments of the present invention.

FIG. 3 is a schematic diagram of a pixel set 120 according to multiple embodiments of the present invention. Relatively thick line segments respectively represent outlines of a first pixel 140 and a second pixel 160, and relatively thin line segments divide the first pixel 140 to form a combination of a first sub-pixel 142, a second sub-pixel 144, and a third sub-pixel 146, and divide the second pixel 160 to form a combination of a fourth sub-pixel 162, a fifth sub-pixel 164, and a sixth sub-pixel 166. As shown in FIG. 3, in this embodiment, each pixel set 120 may respectively include the first pixel 140 and the second pixel 160, where a relative relationship between the first pixel 140 and the second pixel 160 is described in detail hereinafter. The first pixel 140 includes the first sub-pixel 142, the second sub-pixel 144, and the third sub-pixel 146. The first sub-pixel 142, the second sub-pixel 144, and the third sub-pixel 146 all have a quadrilateral shape, for example, a parallelogram shape. Two adjacent edges of any one of the first sub-pixel 142, the second sub-pixel 144, and the third sub-pixel 146 adjoin the other two of the first sub-pixel 142, the second sub-pixel 144, and the third sub-pixel 146, respectively, so that the first pixel 140 has a hexagonal shape. The second pixel 160 includes the fourth sub-pixel 162, the fifth sub-pixel 164, and the sixth sub-pixel 166. The fourth sub-pixel 162, the fifth sub-pixel 164, and the sixth sub-pixel 166 all have a quadrilateral shape, for example, a parallelogram shape. Two adjacent edges of any one of the fourth sub-pixel 162, the fifth sub-pixel 164, and the sixth sub-pixel 166 adjoin the other two of the fourth sub-pixel 162, the fifth sub-pixel 164, and the sixth sub-pixel 166, respectively, so that the second pixel 160 has a hexagonal shape. In other words, the first sub-pixel 142, the second sub-pixel 144, and the third sub-pixel 146 may be parts formed by dividing the first pixel 140 having a hexagonal shape, and the first sub-pixel 142, the second sub-pixel 144, and the third sub-pixel 146 that are formed through division have a quadrilateral shape. Similarly, the fourth sub-pixel 162, the fifth sub-pixel 164, and the sixth sub-pixel 166 are parts formed by dividing the second pixel 160 having a hexagonal shape. In multiple embodiments, after a rotation by 180 degrees, shapes of the first sub-pixel 142, the second sub-pixel 144, and the third sub-pixel 146 of the first pixel 140 are substantially the same as shapes of the fourth sub-pixel 162, the fifth sub-pixel 164, and the sixth sub-pixel 166 of the second pixel 160, and the fourth sub-pixel 162 may correspond to the first sub-pixel 142. The fourth sub-pixel 162 of the second pixel 160 adjoins the first sub-pixel 142 of the first pixel 140.

As shown in FIG. 3, the sub-pixels are filled by different mesh units, and patterns of different mesh units may represent sub-pixels having different colors. In this embodiment, the first sub-pixel 142, the second sub-pixel 144, and the third sub-pixel 146 have different colors, the fourth sub-pixel 162, the fifth sub-pixel 164, and the sixth sub-pixel 166 have different colors, and the first sub-pixel 142 and the fourth sub-pixel 162 have different colors. In this embodiment, a color configuration of the first pixel 140 and the second pixel 160 may be shown in FIG. 3, the color of the first sub-pixel 142 is the same as the color of the fifth sub-pixel 164, the color of the second sub-pixel 144 is the same as the color of the sixth sub-pixel 166, and the color of the third sub-pixel 146 is the same as the color of the fourth sub-pixel 162. In this way, colors emitted by the first pixel 140 and the second pixel 160 are mixed and may become relatively uniform.

It should be noted that, the configuration manner of the colors of the first pixel 140 and the second pixel 160 discussed herein and the area configuration of the sub-pixels are merely exemplary and are not used to limit the present invention. It should be understood that a person of ordinary skill in the art may make a moderate change or replacement according to an actual need without departing from the spirit and scope of the present disclosure, as long as a combination of the first sub-pixel 142, the second sub-pixel 144, and the third sub-pixel 146 and a combination of the fourth sub-pixel 162, the fifth sub-pixel 164, and the sixth sub-pixel 166 can have three different colors, respectively, and when the first pixels 140 and the second pixels 160 work together, color mixing of the pixel set 120 is uniform.

In multiple embodiments, the colors of the first sub-pixel 142, the second sub-pixel 144, the third sub-pixel 146, the fourth sub-pixel 162, the fifth sub-pixel 164, and the sixth sub-pixel 166 are red, blue or green, respectively. For example, the colors of the first sub-pixel 142, the second sub-pixel 144, and the third sub-pixel 146 may be red, green, and blue, respectively, and the colors of the fourth sub-pixel 162, the fifth sub-pixel 164, and the sixth sub-pixel 166 may be blue, green, and red, respectively. It should be understood that, the color configuration of the first sub-pixel 142, the second sub-pixel 144, the third sub-pixel 146, the fourth sub-pixel 162, the fifth sub-pixel 164, and the sixth sub-pixel 166 discussed herein merely exemplary, and is not used to limit the present disclosure. In addition, in multiple other embodiments, the colors of the first sub-pixel 142, the second sub-pixel 144, the third sub-pixel 146, the fourth sub-pixel 162, the fifth sub-pixel 164, and the sixth sub-pixel 166 may also be one of yellow, cyan and magenta.

In this embodiment, the first sub-pixel 142, the second sub-pixel 144, the third sub-pixel 146, the fourth sub-pixel 162, the fifth sub-pixel 164, and the sixth sub-pixel 166 may have a parallelogram shape. In other multiple embodiments, the first sub-pixel 142, the second sub-pixel 144, the third sub-pixel 146, the fourth sub-pixel 162, the fifth sub-pixel 164, and the sixth sub-pixel 166 may also have an irregular quadrilateral shape. In multiple embodiments, areas that the first sub-pixel 142, the second sub-pixel 144, and the third sub-pixel 146 have respectively may be different. In multiple embodiments, areas that the fourth sub-pixel 162, the fifth sub-pixel 164, and the sixth sub-pixel 166 respectively have may be different.

Figure 4:
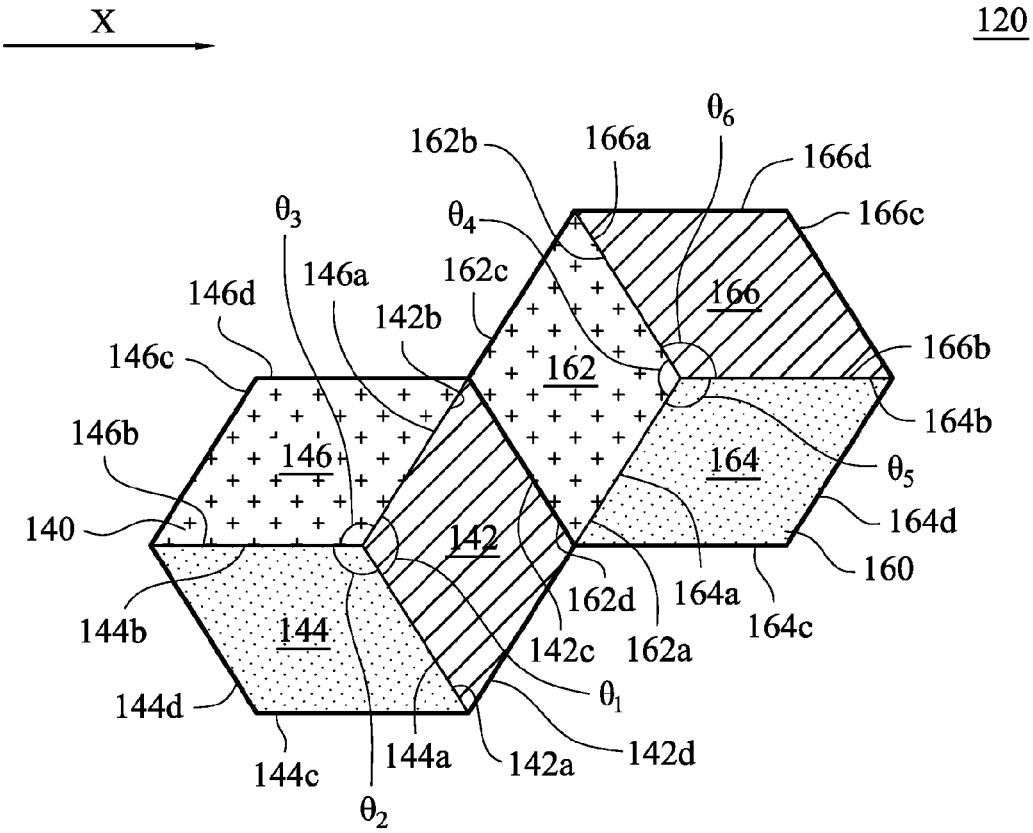
FIG. 4 is a schematic diagram of a pixel set according to multiple other embodiments of the present invention.

FIG. 4 is a schematic diagram of a pixel set 120 according to another embodiment of the present invention. As shown in FIG. 4, in this embodiment, both a first sub-pixel 142 and a fourth sub-pixel 162 have a rhombic shape. A second sub-pixel 144, a third sub-pixel 146, a fifth sub-pixel 164, and a sixth sub-pixel 166 have a parallelogram shape. Furthermore, in other embodiments, the second sub-pixel 144 and the third sub-pixel 146 are rhombuses having edge lengths equal to those of the first sub-pixel 142, and each sub-pixel adjoin other two sub-pixels respectively by using two adjacent edges between which an obtuse angle is included, so that a first pixel 140 has a regular hexagonal shape. Similarly, the fifth sub-pixel 164 and the sixth sub-pixel 166 are rhombuses having edge lengths equal to that of the fourth sub-pixel 162, so that a second pixel 160 has a regular hexagonal shape.

In this embodiment, a first edge 142*a* of the first sub-pixel 142 and a first edge 144*a* of the second sub-pixel 144 adjoin each other, a second edge 142*b* of the first sub-pixel 142 and a first edge 146*a* of the third sub-pixel 146 adjoin each other, and a second edge 144*b* of the second sub-pixel 144 and a second edge 146*b* of the third sub-pixel 146 adjoin each other. The first edge 142*a* and the second edge 142*b* of the first sub-pixel 142 are connected, and a first angle θ1 is included between the first edge 142*a* and the second edge 142*b*. The first edge 144*a* and the second edge 144*b* of the second sub-pixel 144 are connected, and a second angle θ2 is included between the first edge 144*a* and the second edge 144*b*. The first edge 146*a* and the second edge 146*b* of the third sub-pixel 146 are connected, and a third angle θ3 is included between the first edge 146*a* and the second edge 146*b*. The first sub-pixel 142 further has a third edge 142*c* and a fourth edge 142*d*, the second sub-pixel 144 further has a third edge 144*c* and a fourth edge 144*d*, and the third sub-pixel 146 further has a third edge 146*c* and a fourth edge 146*d*, where these edges are used as six edges of a hexagon and combined sequentially to form first pixel 140 having a hexagonal shape. When the first angle θ1, the second angle θ2, and the third angle θ3 are substantially equal and the edge lengths of the foregoing six edges are substantially equal, the first pixel 140 has a regular hexagonal shape. In this embodiment, a first edge 162*a* of the fourth sub-pixel 162 and a first edge 164*a* of the fifth sub-pixel 164 adjoin each other, a second edge 162*b* of the fourth sub-pixel 162 and a first edge 166*a* of the sixth sub-pixel 166 adjoin each other, and a second edge 164*b* of the fifth sub-pixel 164 and a second edge 166*b* of the sixth sub-pixel 166 adjoin each other, where the first edge 162*a* and the second edge 162*b* of the fourth sub-pixel 162 are connected, a fourth angle θ4 is included between the first edge 162*a* and the second edge 162*b*, the first edge 164*a* and the second edge 164*b* of the fifth sub-pixel 164 are connected, a fifth angle θ5 is included between the first edge 164*a* and the second edge 164*b*, the first edge 166*a* and the second edge 166*b* of the sixth sub-pixel 166 are connected, and a sixth angle θ6 is included between the first edge 166*a* and the second edge 166*b*. The fourth sub-pixel 162 further has a third edge 162*c* and a fourth edge 162*d*, the fifth sub-pixel 164 further has a third edge 164*c* and a fourth edge 164*d*, and the sixth sub-pixel 166 further has a third edge 166*c* and a fourth edge 166*d*; these edges are used as six edges of a hexagon and sequentially combined to form the second pixel 160 having a hexagonal shape. When the fourth angle θ4, the fifth angle θ5, and the sixth angle θ6 are substantially equal and the edge lengths of the foregoing six edges are substantially equal, the second pixel 160 has a regular hexagonal shape. In this embodiment, the third edge 142*c* or the fourth edge 142*d* of the first sub-pixel 142 of the first pixel 140 adjoins the third edge 162*c* or the fourth edge 162*d* of the fourth sub-pixel 162 of the second pixel 160, so as to form the pixel set 120. It should be noted that, the regular hexagonal shape shown herein is merely exemplary, and the hexagonal shape of the present invention is not limited to only a regular hexagonal shape.

As discussed above, the second sub-pixel 144 adjoins the third sub-pixel 146 via the second edge 144*b*. In this embodiment, an extending direction of the second edge 144*b* of the second sub-pixel 144 and the second edge 146*b* of the third sub-pixel 146 is substantially parallel to a first direction X, for example, a horizontal direction. Similarly, the fifth sub-pixel 164 adjoins the sixth sub-pixel 166 via the second edge 164*b*. In this embodiment, an extending direction of the second edge 164*b* of the fifth sub-pixel 164 and the second edge 166*b* of the sixth sub-pixel 166 is substantially parallel to the first direction X. It should be noted that, in other embodiments, the second edge 164*b* of the fifth sub-pixel 164 may also extend in a direction different from that of the second edge 144*b* of the second sub-pixel 144, and the pixel set 120 discussed herein is only one of the implementation examples, and is not used to limit the present invention. It should be understood that a person of ordinary skill in the art may make a moderate change or replacement according to an actual need without departing from the spirit and scope of the present disclosure.

Figure 5:
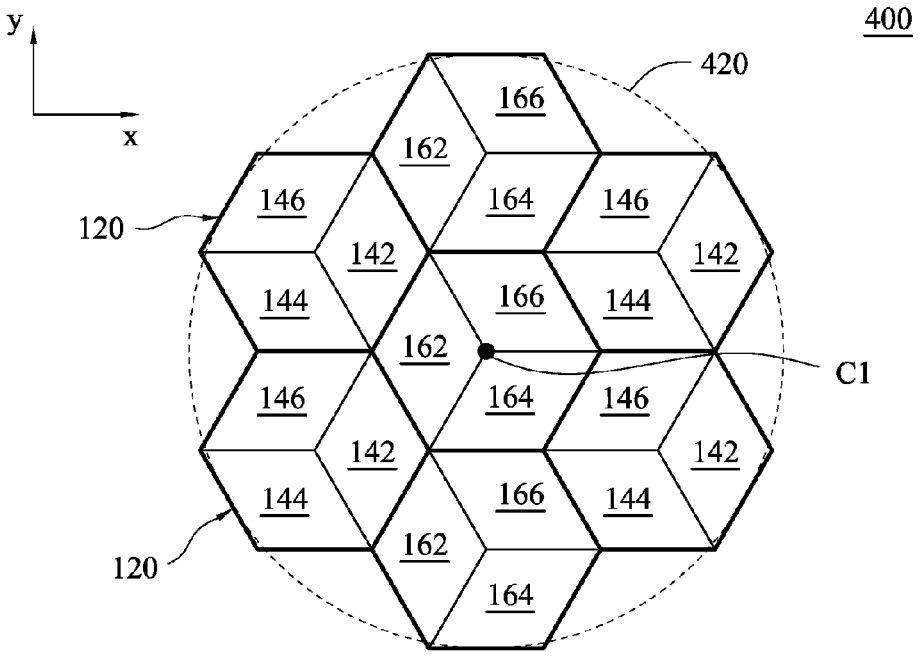
FIG. 5 to FIG. 7 are schematic diagrams of configuration manners of a plurality of pixels and/or pixel sets according to multiple different embodiments of the present invention.
Figure 6:
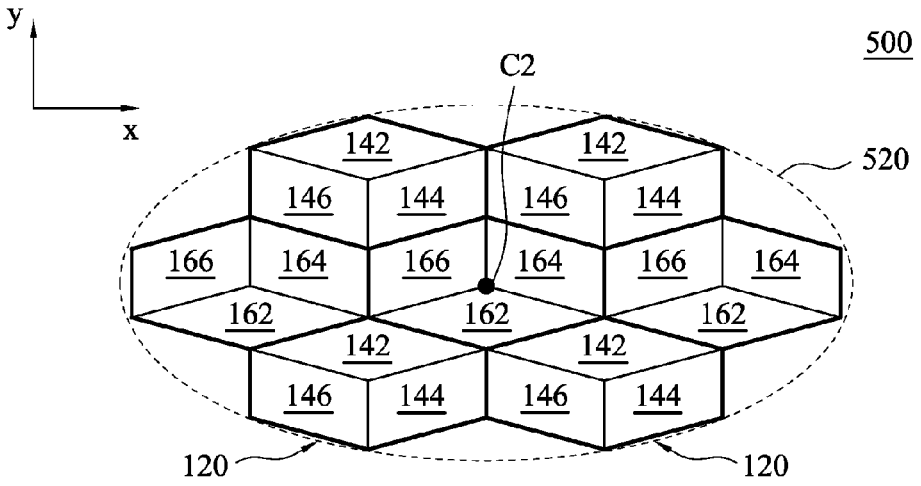
Figure 7:
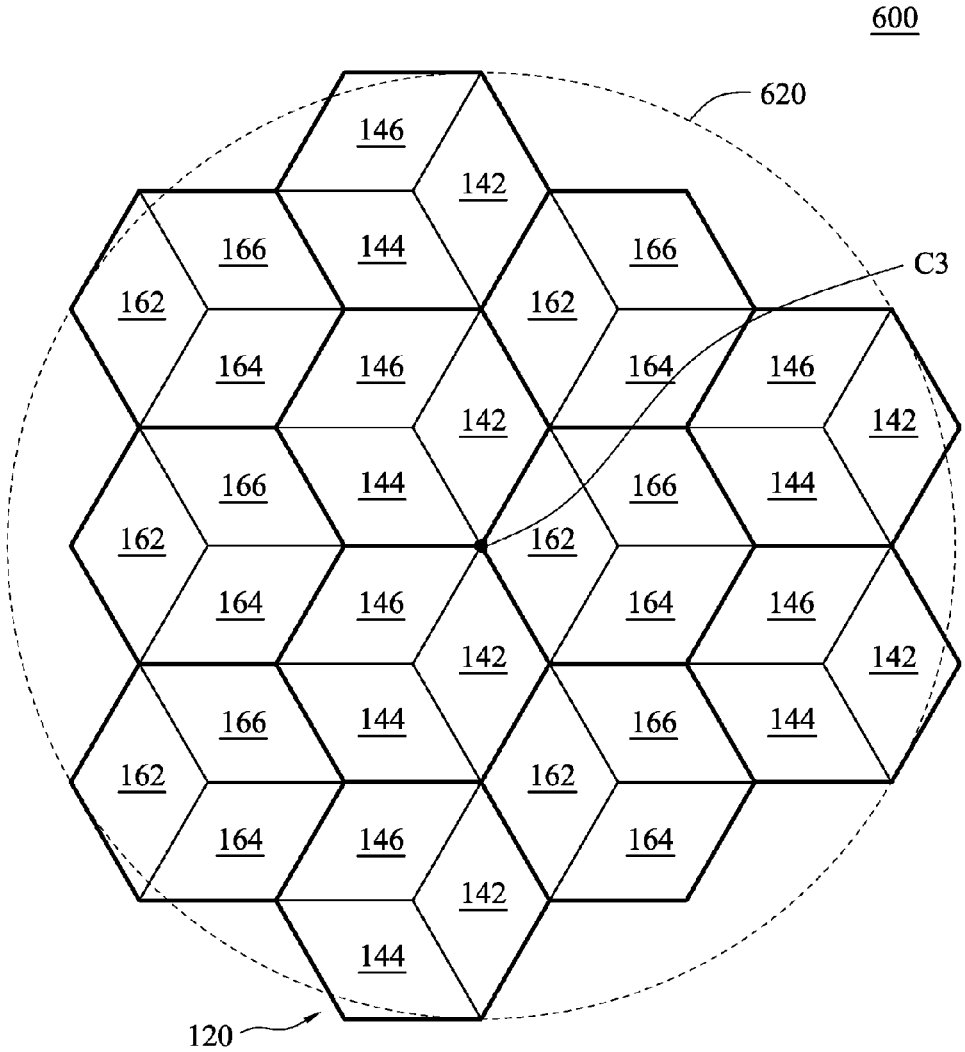

FIG. 5 to FIG. 7 are schematic diagrams of configuration manners of a plurality of first pixels 140 and second pixels 160, and pixel sets 120 according to multiple different embodiments of the present invention. Dotted line portions schematically represent outer frames 420, 520, 620 of display apparatuses, respectively. Referring to FIG. 5, in this embodiment, a plurality of pixel sets 120 is adjoined in sequence in a first direction X and in a second direction Y substantially perpendicular to the first direction X, to form an array, where the first sub-pixels 142 and the fourth sub-pixels 162 substantially adjoin in sequence in the second direction Y, the second sub-pixels 144 and the third sub-pixels 146 substantially adjoin alternately in the second direction Y, and the fifth sub-pixels 164 and the sixth sub-pixels 166 substantially adjoin in the second direction Y. It should be noted that, the second direction Y substantially perpendicular to the first direction X shown herein is merely exemplary, and is not used to limit the present invention. A person of ordinary skill in the art may make a moderate change or replacement according to an actual need without departing from the spirit and scope of the present disclosure, as long as the second direction Y and the first direction X are different.

In this embodiment, the second sub-pixel 144 of a pixel set 120 adjoins the sixth sub-pixel 166 of another pixel set 120 in the first direction X, and the third sub-pixel 146 of a pixel set 120 adjoins the fifth sub-pixel 164 of another pixel set 120 in the first direction X. It should be noted that, the adjoining relationship shown herein is merely exemplary, and is not used to limit the present invention. Even if the second sub-pixel 144 and the third sub-pixel 146 are switched and the adjoining relationship between the second sub-pixel 144 and the third sub-pixel 146 is changed, the case still fall within the protection scope of the present invention. A person of ordinary skill in the art may make a moderate change or replacement according to an actual need without departing from the spirit and scope of the present disclosure.

Referring to FIG. 6 and FIG. 5 together, even if arrangement directions of the first pixels 140 and the second pixels 160 of the pixel sets 120 in FIG. 6 are changed, a relative relationship among the pixel sets 120, the first pixels 140, and the second pixels 160 is still substantially the same as the relationship in FIG. 5. However, through comparison of a pixel array 500 in FIG. 6 and a pixel array 400 in FIG. 5, it can be seen that the arrangement of the first pixels 140 and the second pixels 160 in the pixel array 500 is obtained after the first pixels 140 and the second pixels 160 in the pixel array 400 are rotated clockwise by approximately 90 degrees and are then arranged in a matrix in the first direction X and the second direction Y. A length-width ratio in the first direction X and the second direction Y of the first pixels 140 and the second pixels 160 in the pixel array 500 is different from a length-width ratio in the first direction X and the second direction Y of the first pixels 140 and the second pixels 160 in the pixel array 400. It is obvious that the first pixels 140 and the second pixels 160 may adapt to an outer frame of a display apparatus having a different length-width ratio by changing a length-width ratio. However, the present invention is not limited thereto. In some of the embodiments, a method of adding more pixel sets 120 may also be used to cover an outer frame of a display apparatus having a different length-width ratio. A person of ordinary skill in the art may make a moderate change or replacement according to an actual need without departing from the spirit and scope of the present disclosure.

Referring to FIG. 5 to FIG. 7 together, FIG. 5, FIG. 6, and FIG. 7 respectively show cases in which the pixel array 400 uses a center c1 as the center, the pixel array 500 uses a center c2 as the center, and a pixel array 600 uses a center c3 as the center, the first pixels 140, the second pixels 160 or the pixel sets 120 are respectively combined, and areas defined by the outer frames 420, 520, 620 are covered to the greatest extent. However, coverage manners of configurations shown in FIG. 5, FIG. 6, and FIG. 7 are slightly different. In multiple embodiments of the present disclosure, for example, for a case shown in FIG. 5, the center c1 of the pixel array 400 may be located at the center of a single pixel, for example, the center c1 of the pixel array 400 substantially overlaps the center of a second pixel 160. Meanwhile, an edge of a first pixel 140 or a second pixel 160 located at an edge is at least partially tangential to the outer frame 420, so that the first pixel 140 or the second pixel 160 at the edge has a very small part of area outside the outer frame 420, but an overall light-emitting area of the first pixel 140 or the second pixel 160 is only slightly affected, so that color mixing of the first pixel 140 or the second pixel 160 does not become uneven. In other multiple embodiments of the present disclosure, for example, for a case shown in FIG. 6, the center c2 of the pixel array 500 may be located at the center of a single pixel, for example, the center c2 of the pixel array 500 substantially overlaps the center of a second pixel 160. Meanwhile, a boundary of the first pixel 140 or the second pixel 160 located at an edge may be shrunk into the outer frame 520, so that it is avoided that a part of an area of the first pixel 140 or the second pixel 160 exceeds a range enclosed by the outer frame 520. In other multiple embodiments of the present disclosure, for example, for a case shown in FIG. 7, the center c3 of the pixel array 600 may be located at an edge between adjacent pixels. Meanwhile, an endpoint on a boundary of a first pixel 140 or a second pixel 160 located at an edge may be located on the outer frame 620, so that a part of the area of the first pixel 140 or the second pixel 160 at the edge is located outside the outer frame 620. Therefore, by choosing this embodiment, a larger coverage area can be achieved in combination with an outer frame having a different demand.

It should be noted that, the configuration manner of pixels and the configuration of pixels relative to an outer frame that are discussed herein are merely exemplary, and are not used to limit the present invention. It should be understood that a person of ordinary skill in the art may make a moderate change or replacement according to an actual need without departing from the spirit and scope of the present disclosure, as long as a desirable balance can be achieved between a coverage area and color mixing of pixels at edges.

Figure 8:
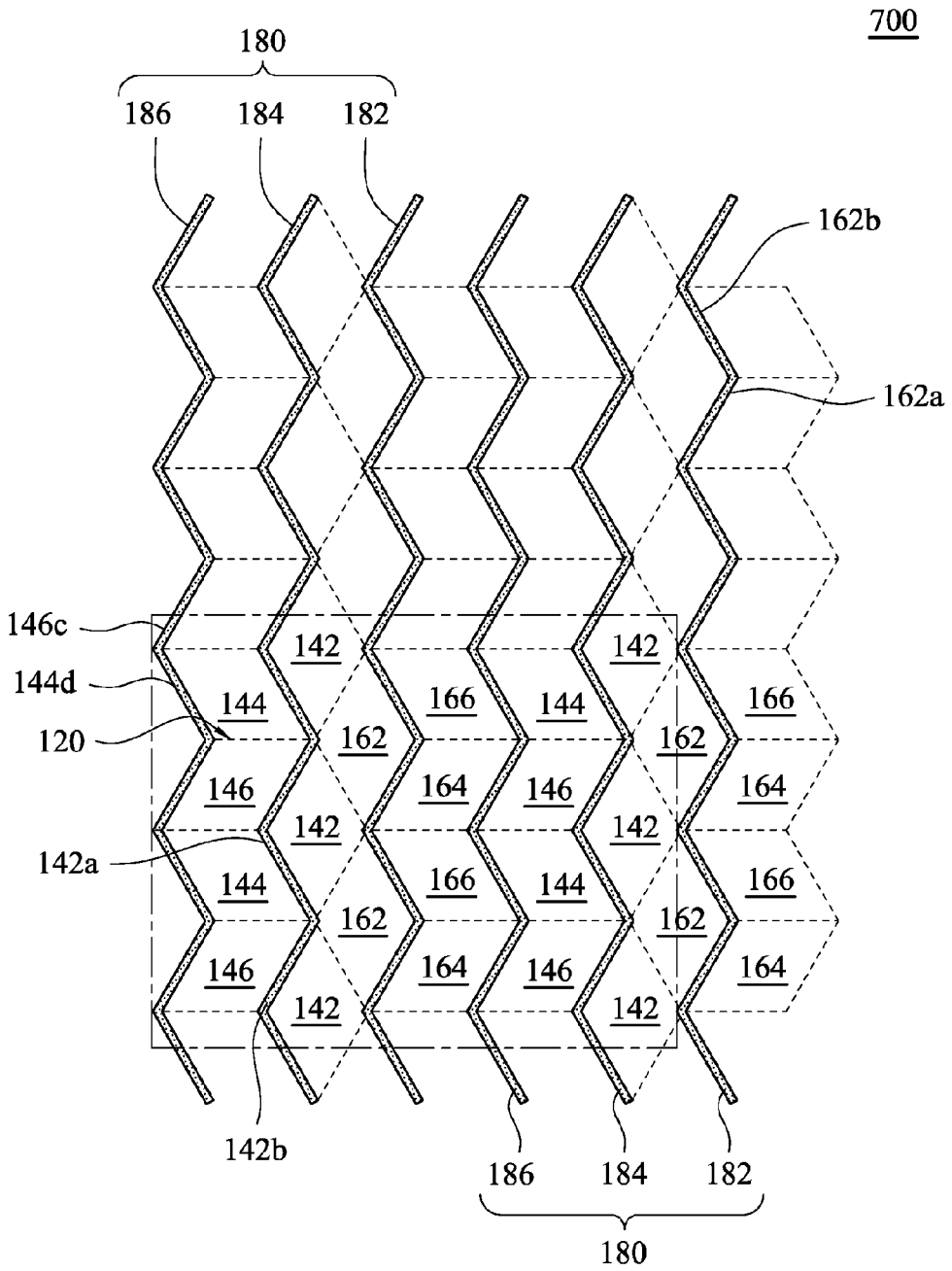
FIG. 8 is a schematic diagram of a configuration of a plurality of pixel sets and data line sets according to multiple embodiments of the present invention.
Figure 9:
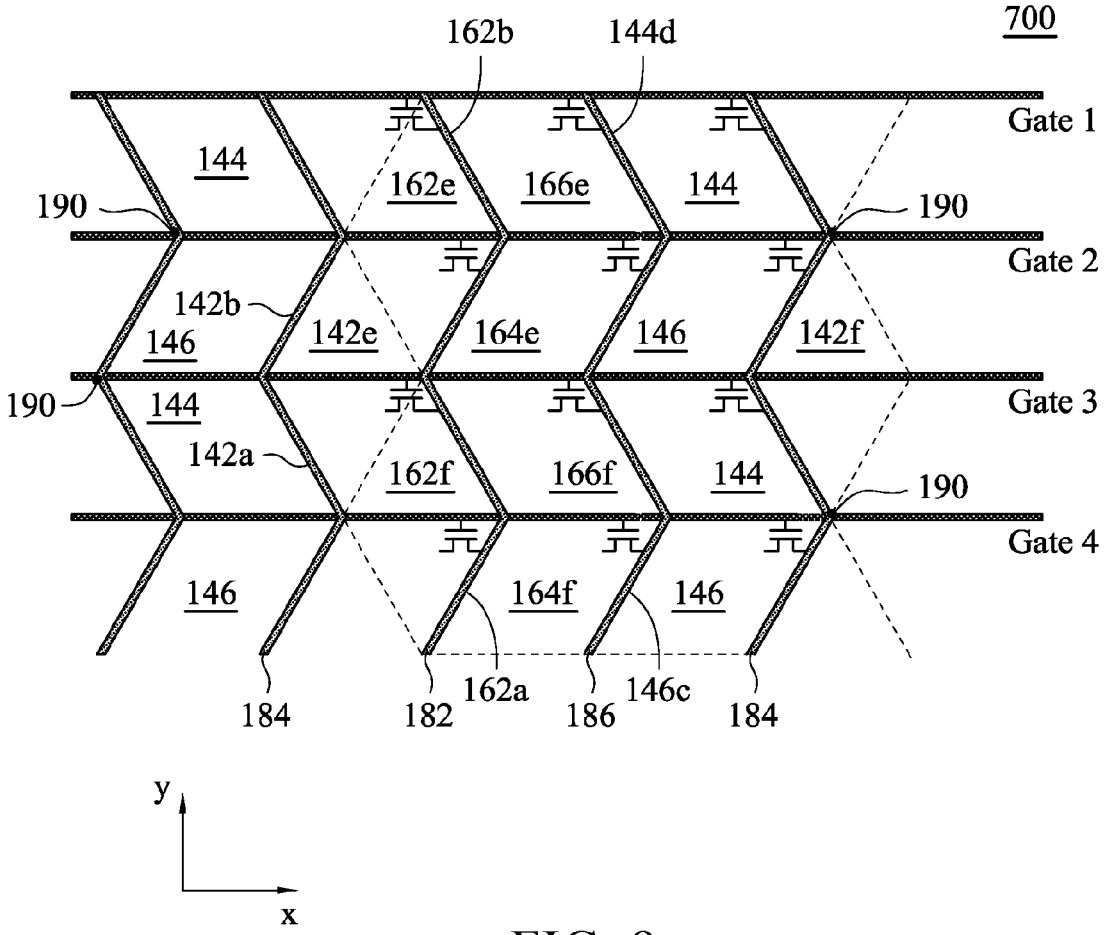
FIG. 9 is a schematic diagram of a configuration of a first pixel, a second pixel, a data line set, and scan lines according to multiple embodiments of the present invention.

FIG. 8 is a schematic diagram of a configuration of a plurality of pixel sets 120 and data line sets 180 according to multiple embodiments of the present invention. Edges of sub-pixels in a pixel set 120 are represented by using a dotted line. FIG. 9 is a range, being enlarged, that is defined by a dotted line box in FIG. 8, and is a schematic diagram of a configuration of a first pixel 140, a second pixel 160, a data line set 180, and scan lines Gate1, Gate2, Gate3, and Gate4 according to multiple embodiments of the present invention. Edges of sub-pixels in a pixel set 120 are represented by using a dotted line. As shown in FIG. 8 and FIG. 9, in this embodiment, a pixel array 700 may further include a plurality of data line sets 180 and a plurality of scan lines Gate1, Gate2, Gate3, and Gate4 (shown in FIG. 9). In multiple embodiments, each data line set 180 may include a first data line 182, a second data line 184, and a third data line 186. In this embodiment, the first data line 182 may extend along first edges 162*a* and second edges 162*b* of fourth sub-pixels 162 of a plurality of pixel sets 120 adjacent in a row direction (Y direction). The second data line 184 may extend along first edges 142*a* and second edges 142*b* of first sub-pixels 142 of the plurality of pixel sets 120 adjacent in a row direction. The third data line 186 may extend between the first pixels 140 of the plurality of pixel sets 120 adjacent in a row direction and the second pixels 160 of the plurality of pixel sets 120 adjacent in a row direction, that is, may extend along fourth edges 144*d* of second sub-pixels 144 and third edges 146*c* of third sub-pixels 146 of the plurality of pixel sets 120 adjacent in a row direction, in other words, may extend along fourth edges 164*d* of fifth sub-pixels 164 and third edges 166*c* of sixth sub-pixels 166 of the plurality of pixel sets 120 adjacent in a row direction; however, the present invention is not limited thereto.

Referring to FIG. 9, the plurality of scan lines Gate1, Gate2, Gate3, and Gate4 included in the pixel array 700 is disposed parallel to each other. The scan lines Gate1, Gate2, Gate3, and Gate4 intersect with the first data lines 182, the second data lines 184, and the third data lines 186, respectively, and are electrically connected to transistors, respectively. It should be noted that the quantity of the scan lines Gate1, Gate2, Gate3, and Gate4 shown here and a first direction X in which the scan lines extend are merely exemplary, and are not used to limit the present invention. A person of ordinary skill in the art may make a moderate change or replacement according to an actual need without departing from the spirit and scope of the present disclosure, as long as the scan lines Gate1, Gate2, Gate3, and Gate4 can be separated from each other, and intersect with the first data lines 182, the second data lines 184, and the third data lines 186, respectively, and sub-pixels are controlled by using transistors located at positions of intersections (for example, bending points 190).

In multiple embodiments, the first data lines 182, the second data lines 184, and the third data lines 186 have a saw-tooth shape or a Zigzag shape, and have a plurality of bending points 190, respectively, and the bending points 190 are respectively located at positions where the first data lines 182, the second data lines 184, and the third data lines 186 bend. In other words, because the first data lines 182, the second data lines 184, and the third data lines 186 extend along different edges of sub-pixels in a pixel set 120, respectively, the so-called bending points 190 actually may spatially overlap endpoints of the sub-pixels. The plurality of scan lines Gate1, Gate2, Gate3, and Gate4 intersects with the first data lines 182, the second data lines 184, and the third data lines 186 at the multiple different bending points 190, respectively.

Because the data line sets 180 and the scan lines Gate1, Gate2, Gate3, and Gate4 included in the pixel array 700 have substantially a same scanning manner and a same control manner as conventional data lines and scan lines that are arranged in a crisscross manner, for control of driving of a chip, the pixel array 700 may continue to use a conventional driving manner for data lines and scan lines that are arranged in a crisscross manner, and the driving manner can still work. Therefore, for the pixel array 700 of the present disclosure, not only a visual defect of saw-tooth shapes in an area near an edge of an outer frame can be eliminated, a relatively simple control manner can also be used.

In multiple embodiments, an edge where the second sub-pixel 144 and the third sub-pixel 146 adjoin each other is parallel to the first direction X, a plurality of scan lines Gate1, Gate2, Gate3, and Gate4 substantially may extend along the first direction X, traverse a plurality of the first sub-pixels 142 and a plurality of fourth sub-pixels 162, respectively, and divide the first sub-pixel 142 and the fourth sub-pixel 162 into two parts, for example, the first sub-pixel 142*e*, the first sub-pixel 142*f*, the fourth sub-pixel 162*e*, and the fourth sub-pixel 162*f*. In multiple embodiments, the scan lines Gate1, Gate2, Gate3, and Gate4 may work together with the first data line 182 respectively to control the first sub-pixels 142 or the fourth sub-pixels 162 traversed by the scan lines Gate1, Gate2, Gate3, and Gate4. For example, the scan line Gate2 may work together with the first data line 182 to control the fourth sub-pixel 162*e*. For example, the scan line Gate3 work together with the first data line 182 to control the first sub-pixel 142*e*. For example, a scan line Gate4 may work together with the first data line 182 to control the fourth sub-pixel 162*f*. For example, the scan line Gate3 may work together with the first data line 182 of another data line set to control the first sub-pixel 142*f*.

In multiple embodiments, the second data line 184 works together with the scan lines Gate1, Gate2, Gate3, and Gate4 to control the second sub-pixel 144*s* and the third sub-pixels 146. In multiple embodiments, the third data line 186 and the scan lines Gate1, Gate2, Gate3, and Gate4 work together to control the fifth sub-pixels 164 and the sixth sub-pixels 166. For example, the scan line Gate2 may work together with the third data line 186 to control the fifth sub-pixel 164*e*. For example, the scan line Gate4 may work together with the third data line 186 to control the fifth sub-pixel 164*f*. For example, the scan line Gate1 may work together with the third data line 186 to control the sixth sub-pixel 166*e*. For example, the scan line Gate3 may work together with the third data line 186 to control the sixth sub-pixel 166*f*.

Figure 10:
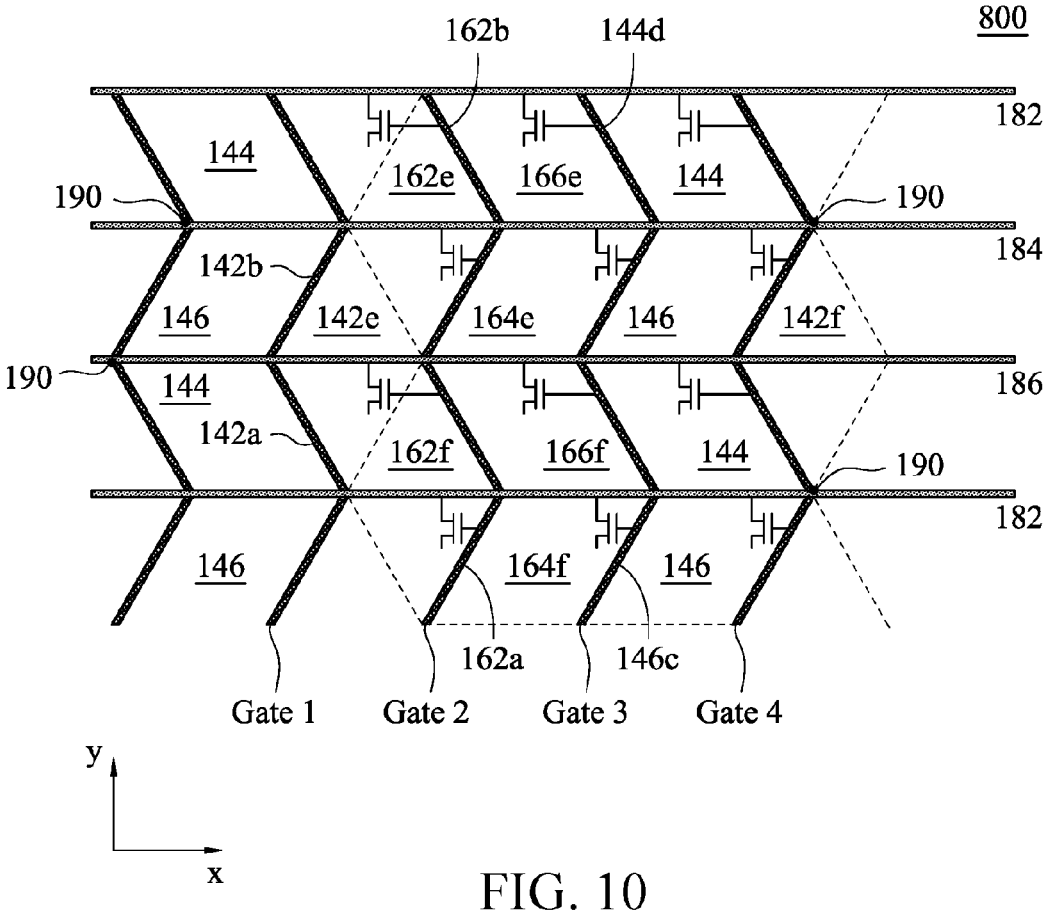
FIG. 10 is a schematic diagram of a configuration of a first pixel, a second pixel, a data line set, and scan lines according to multiple embodiments of the present invention.

FIG. 10 is a schematic diagram of a configuration of a first pixel 140, a second pixel 160, a data line set 180, and scan lines Gate1, Gate2, Gate3, and Gate4 according to multiple other embodiments of the present invention. Edges of sub-pixels in a pixel set 120 are represented by dotted lines. As shown in FIG. 10, in other multiple embodiments, a pixel array 800 may further include a plurality of data line sets 180 and a plurality of scan lines Gate1, Gate2, Gate3, and Gate4. In multiple embodiments, each data line set 180 may include a first data line 182, a second data line 184, and a third data line 186, which are disposed parallel to each other in a horizontal direction (X direction). In multiple embodiments, the scan line Gate1 and a scan line Gate4 may extend along first edges 142*a* and second edges 142*b* of first sub-pixels 142 of a plurality of adjacent pixel sets 120. The scan line Gate2 may extend along first edges 162*a* and second edges 162*b* of fourth sub-pixels 162 of the plurality of adjacent pixel sets 120. The scan line Gate3 may extend along fourth edges 144*d* of second sub-pixels 144 and third edges 146*c* of third sub-pixel 146*s* of the plurality of pixel sets 120 adjacent in a row direction. In multiple embodiments, the pixel array 800 may substantially similar to a result by switching the data line sets 180 and the scan lines Gate1, Gate2, Gate3, and Gate4 in the pixel array 700.

It should be noted that, the scan lines Gate1, Gate2, Gate3, and Gate4 shown herein are merely exemplary, and are not used to limit the present invention. In multiple embodiments, the pixel array 800 may include another plurality of scan lines, and the scan lines may extend along the first edges 142*a* and the second edges 142*b* of the first sub-pixels 142 of the plurality of adjacent pixel sets 120, respectively, extend along the first edges 162*a* and the second edges 162*b* of the fourth sub-pixels 162 of the plurality of adjacent pixel sets 120, and extend along the fourth edges 144*d* of the second sub-pixels 144 and the third edges 146*c* of the third sub-pixels 146 of the plurality of adjacent pixel sets 120. The data lines, for example, the first data line 182, the second data line 184, and the third data line 186, in the data line set 180 intersect with the scan lines Gate1, Gate2, Gate3, and Gate4 respectively, and are electrically connected to transistors, respectively.

It should be understood that a manner in which the scan lines Gate1, Gate2, Gate3, and Gate4 and the first data line 182, the second data line 184, the third data line 186 in the pixel array 700 and the pixel array 800 discussed herein work together to perform control is merely exemplary, but is not used to limit the present invention. For example, in other multiple embodiments, the scan lines Gate1, Gate2, Gate3, and Gate4 may also work together with the second data line 184 respectively to control the first sub-pixel 142 or the fourth sub-pixel 162 traversed by the scan lines Gate1, Gate2, Gate3, and Gate4. It should be understood that a person of ordinary skill in the art may make a moderate change or replacement according to an actual need without departing from the spirit and scope of the present disclosure, as long as the data line set 180 can work together with the scan lines Gate1, Gate2, Gate3, and Gate4 to control display statuses of sub-pixels in the pixel set 120.

In conclusion, the pixel array provided by the present invention includes a plurality of pixel sets. The plurality of pixel sets is adjacent to each other. Each pixel set respectively includes a first pixel and a second pixel. The first pixel includes a first sub-pixel, a second sub-pixel, and a third sub-pixel. The first sub-pixel, the second sub-pixel, and the third sub-pixel have a quadrilateral shape. Two adjacent edges of any one of the first sub-pixel, the second sub-pixel, and the third sub-pixel adjoin the other two of, respectively, so that the first pixel has a hexagonal shape. The first sub-pixel, the second sub-pixel, and the third sub-pixel have different colors. The second pixel includes a fourth sub-pixel, a fifth sub-pixel, and a sixth sub-pixel. The fourth sub-pixel, the fifth sub-pixel, and the sixth sub-pixel have a quadrilateral shape. Two adjacent edges of any one of the fourth sub-pixel, the fifth sub-pixel, and the sixth sub-pixel adjoin the other two of, respectively, so that the second pixel has a hexagonal shape. The fourth sub-pixel, the fifth sub-pixel, and the sixth sub-pixel have different colors. After a rotation by 180 degrees, shapes of the first sub-pixel, the second sub-pixel, and the third sub-pixel of the first pixel are substantially the same as shapes of the fourth sub-pixel, the fifth sub-pixel, and the sixth sub-pixel of the second pixel, and the fourth sub-pixel corresponds to the first sub-pixel. The fourth sub-pixel of the second pixel adjoins the first sub-pixel of the first pixel. Pixel sets formed of hexagonal pixels may relatively cover display shapes of display surfaces defined by outer frames of various different display apparatuses to the greatest extent, so that such pixel sets can more efficiently fill space inside the outer frames having different shapes, especially an area near an edge of an outer frame. In addition, by configuring a manner of dividing a pixel into sub-pixels, for the pixel set of the present invention, a relatively simple control circuit can still be used to control a display status of a pixel. In this way, the pixel array can cover display surfaces defined by outer frames of display apparatuses having different shapes more desirably and more efficiently without increasing the complexity of a control circuit, so as to reduce or avoid relatively undesirable effects of color emission and relatively undesirable image effects that occur in edge areas of the outer frames of the display apparatuses.

Although the present invention has been disclosed above by using the embodiments, the embodiments are not used to limit the present invention. Any person skilled in the art may make various variations and modifications without departing from the spirit and scope of the present invention, and therefore the protection scope of the present invention should be as defined by the appended claims.

What is claimed is:

1. A pixel array, comprising a plurality of pixel sets, the pixel sets being adjacent to each other, each pixel set comprising:

a first hexagonal shaped pixel, comprising a first sub-pixel, a second sub-pixel, and a third sub-pixel, wherein the first sub-pixel, the second sub-pixel, and the third sub-pixel are in a quadrilateral shape, the first sub-pixel, the second sub-pixel, and the third sub-pixel adjoin each other by two adjacent edges of each of the first sub-pixel, the second sub-pixel, and the third sub-pixel respectively, and the first sub-pixel, the second sub-pixel, and the third sub-pixel have different colors; and a second hexagonal shaped pixel, comprising a fourth sub-pixel, a fifth sub-pixel, and a sixth sub-pixel, wherein the fourth sub-pixel, the fifth sub-pixel, and the sixth sub-pixel are in the quadrilateral shape, the fourth sub-pixel, the fifth sub-pixel, and the sixth sub-pixel adjoin each other by two adjacent edges of each of the fourth sub-pixel, the fifth sub-pixel, and the sixth sub-pixel, respectively, and the fourth sub-pixel, the fifth sub-pixel, and the sixth sub-pixel have different colors, wherein after a rotation by 180 degrees, shapes of the first sub-pixel, the second sub-pixel, and the third sub-pixel of the first hexagonal shaped pixel are substantially same shape as the fourth sub-pixel, the fifth sub-pixel, and the sixth sub-pixel of the second hexagonal shaped pixel, respectively; and wherein an edge of the second sub-pixel adjoining the third sub-pixel extends in a first direction, and an edge of the fifth sub-pixel adjoining the sixth sub-pixel extends in the first direction.

2. The pixel array according to claim 1, wherein the first sub-pixel and the fourth sub-pixel have different colors.

3. The pixel array according to claim 1, wherein the colors of the first sub-pixel, the second sub-pixel, the third sub-pixel, the fourth sub-pixel, the fifth sub-pixel, and the sixth sub-pixel are red, blue or green, respectively.

4. The pixel array according to claim 1, wherein the colors of the first sub-pixel, the second sub-pixel, the third sub-pixel, the fourth sub-pixel, the fifth sub-pixel, and the sixth sub-pixel are yellow, cyan or magenta, respectively.

5. The pixel array according to claim 1, wherein the first sub-pixel, the second sub-pixel, the third sub-pixel, the fourth sub-pixel, the fifth sub-pixel, and the sixth sub-pixel have a parallelogram shape.

6. The pixel array according to claim 1, wherein the first sub-pixel and the fourth sub-pixel have a rhombic shape, and the second sub-pixel, the third sub-pixel, the fifth sub-pixel, and the sixth sub-pixel have a parallelogram shape.

7. The pixel array according to claim 6, wherein the second sub-pixel and the third sub-pixel are rhombuses having edge lengths equal to those of the first sub-pixel, the first hexagonal shaped pixel is in a regular hexagonal shape, and the fifth sub-pixel and the sixth sub-pixel are rhombuses having edge lengths equal to those of the fourth sub-pixel, and the second hexagonal shaped pixel is in the regular hexagonal shape.

8. The pixel array according to claim 1, wherein the other two edges of the first sub-pixel adjoin the fourth sub-pixel and a fourth sub-pixel of another pixel set, and in the pixel array, the first sub-pixels and the fourth sub-pixels are arranged in a second direction perpendicular to the first direction, respectively, the second sub-pixels and the third sub-pixels are arranged alternately and adjoin each other in the second direction, and the fifth sub-pixels and the sixth sub-pixels are arranged alternately and adjoin each other in the second direction.

9. The pixel array according to claim 8, further comprising:

a plurality of first signal lines, each first signal line having a plurality of bending points, one of the first signal lines extending along an edge where the first sub-pixel and the second sub-pixel adjoin each other and an edge where the first sub-pixel and the third sub-pixel adjoin each other, one of the first signal lines extending along an edge where the fourth sub-pixel and the fifth sub-pixel adjoin each other and an edge where the fourth sub-pixel and the sixth sub-pixel adjoin each other, and one the first signal line extending along an edge where the second sub-pixel and the sixth sub-pixel adjoin each other and an edge where the third sub-pixel and the fifth sub-pixel adjoin each other;

a plurality of second signal lines, disposed parallel to each other and intersecting with the first signal lines at the bending points, respectively, wherein one of the second signal lines extends along an edge where the second sub-pixel and the third sub-pixel adjoin each other and an edge where the fifth sub-pixel and the sixth sub-pixel adjoin each other, and traverses the plurality of the first sub-pixels, and one of the second signal lines extends along an edge where the second sub-pixel and the third sub-pixel adjoin each other and an edge where the fifth sub-pixel and the sixth sub-pixel adjoin each other, and traverses a plurality of fourth sub-pixels; and a plurality of transistors, used to control the sub-pixels of corresponding pixel sets, the transistor being located at positions of intersections of the first signal lines and the second signal lines, respectively, and being electrically connected to one of the corresponding first signal lines and one of the corresponding second signal lines, respectively.

10. The pixel array according to claim 1, wherein the second sub-pixel and a sixth sub-pixel of a second pixel set are arranged in the first direction, and the third sub-pixel and a fifth sub-pixel of a third pixel set are arranged in the first direction.

11. The pixel array according to claim 1, wherein an arrangement manner of the pixel sets is a honeycomb-like arrangement.

12. The pixel array according to claim 1, wherein a first edge of the first sub-pixel and a first edge of the second sub-pixel adjoin each other, a second edge of the first sub-pixel and a first edge of the third sub-pixel adjoin each other, and a second edge of the second sub-pixel and a second edge of the third sub-pixel adjoin each other;

wherein the first edge and the second edge of the first sub-pixel are adjacent, the first edge and the second edge of the second sub-pixel are adjacent, the first edge and the second edge of the third sub-pixel are adjacent, and a third edge and a fourth edge of the first sub-pixel, a third edge and a fourth edge of the second sub-pixel, and a third edge and a fourth edge of the third sub-pixel are sequentially connected and are served as six edges of the first hexagonal shaped pixel;

wherein a first edge of the fourth sub-pixel and a first edge of the fifth sub-pixel adjoin each other, a second edge of the fourth sub-pixel and a first edge of the sixth sub-pixel adjoin each other, and a second edge of the fifth sub-pixel and a second edge of the sixth sub-pixel adjoin each other;

wherein the first edge and the second edge of the fourth sub-pixel are adjacent, the first edge and the second edge of the fifth sub-pixel are adjacent, the first edge and the second edge of the sixth sub-pixel are adjacent, and a third edge and a fourth edge of the fourth sub-pixel, a third edge and a fourth edge of the fifth sub-pixel, and a third edge and a fourth edge of the sixth sub-pixel are sequentially connected and are served as six edges of the second hexagonal shaped pixel.

13. The pixel array according to claim 12, further comprising:

a plurality of data line sets, each data line set comprising:

a first data line, extending along the first edges and the second edges of the fourth sub-pixels;

a second data line, extending along the first edges and the second edges of the first sub-pixels; and a third data line, extending along the fourth edges of the second sub-pixels and the third edges of the third sub-pixels; and a plurality of scan lines, disposed parallel to each other, the scan lines intersecting with the first data lines, the second data lines, and the third data lines, respectively.

14. The pixel array according to claim 13, each of the first data lines, the second data lines, and the third data lines has a plurality of bending points, wherein the scan lines intersect with the first data lines, the second data lines, and the third data lines at the bending points, respectively.

15. The pixel array according to claim 14, wherein the second edge of the second sub-pixel and the second edge of the third sub-pixel are parallel to a first direction, and the scan lines substantially extend in the first direction, and traverse the first sub-pixels and the fourth sub-pixels, respectively.

16. The pixel array according to claim 15, wherein the scan line and one of the first data lines control the first sub-pixel or the fourth sub-pixel traversed by the scan line.

17. The pixel array according to claim 12, further comprising:

a plurality of scan lines, wherein a plurality of first scan lines extends along the first edges and the second edges of the fourth sub-pixels, respectively, a plurality of second scan lines extends along the first edges and the second edges of the first sub-pixels, respectively, and a plurality of third scan lines extends along the fourth edges of the second sub-pixels and the third edges of the third sub-pixels, respectively; and a plurality of data lines, disposed parallel to each other, the data line intersecting with the scan lines, respectively.

18. The pixel array according to claim 13, wherein the second data line and the scan lines control the second sub-pixel and the third sub-pixel, and the third data line and the scan lines control the fifth sub-pixel and the sixth sub-pixel.

19. A pixel array, comprising a plurality of pixel sets, the pixel sets being adjacent to each other, each pixel set comprising:

a first hexagonal shaped pixel, comprising a first sub-pixel, a second sub-pixel, and a third sub-pixel, wherein the first sub-pixel, the second sub-pixel, and the third sub-pixel are in a quadrilateral shape, the first sub-pixel, the second sub-pixel, and the third sub-pixel adjoin each other by two adjacent edges of each of the first sub-pixel, the second sub-pixel, and the third sub-pixel respectively, and the first sub-pixel, the second sub-pixel, and the third sub-pixel have different colors; and a second hexagonal shaped pixel, comprising a fourth sub-pixel, a fifth sub-pixel, and a sixth sub-pixel, wherein the fourth sub-pixel, the fifth sub-pixel, and the sixth sub-pixel are in the quadrilateral shape, the fourth sub-pixel, the fifth sub-pixel, and the sixth sub-pixel adjoin each other by two adjacent edges of each of the fourth sub-pixel, the fifth sub-pixel, and the sixth sub-pixel, respectively, and the fourth sub-pixel, the fifth sub-pixel, and the sixth sub-pixel have different colors, wherein after a rotation by 180 degrees, shapes of the first sub-pixel, the second sub-pixel, and the third sub-pixel of the first hexagonal shaped pixel are substantially same shape as the fourth sub-pixel, the fifth sub-pixel, and the sixth sub-pixel of the second hexagonal shaped pixel, respectively; and wherein the first sub-pixel and the fourth sub-pixel have a rhombic shape, and the second sub-pixel, the third sub-pixel, the fifth sub-pixel, and the sixth sub-pixel have a parallelogram shape.

* * * * *